United States Patent [19]

Neuhäuser et al.

[11] Patent Number: 4,846,940

[45] Date of Patent: Jul. 11, 1989

[54] ELECTROLYTICALLY DEPOSITED HARD CHRONIUM COATINGS

[75] Inventors: Hans-Jochem Neuhäuser, Bergisch-Gladbach; Ulrich Buran; Rudolf Linde, both of Burscheid, all of Fed. Rep. of Germany

[73] Assignee: Goetze AG, Burscheid, Fed. Rep. of Germany

[21] Appl. No.: 148,174

[22] Filed: Jan. 22, 1988

Related U.S. Application Data

[63] Continuation of Ser. No. 904,022, Sep. 2, 1986.

[30] Foreign Application Priority Data

Sep. 3, 1985 [DE] Fed. Rep. of Germany .... 3531410.9

[51] Int. Cl.[4] ..... C25D 15/00

[52] U.S. Cl. ..... 204/16

[58] Field of Search ..... 204/16, 23, 25, 35.1, 204/41

[56] References Cited

U.S. PATENT DOCUMENTS 3,356,467 12/1967 Brown et al. ..... 428/639
3,844,910 10/1974 Lipp et al. ..... 204/45 R

FOREIGN PATENT DOCUMENTS 2146908 3/1972 Fed. Rep. of Germany .
2230676 1/1973 Fed. Rep. of Germany .
1070343 6/1967 United Kingdom .
1098066 1/1968 United Kingdom ..... 204/41
1220331 1/1971 United Kingdom ..... 204/41

*Primary Examiner*—T. M. Tufariello
*Attorney, Agent, or Firm*—Spencer & Frank

[57] ABSTRACT

Solid particles of primarily hard substances, solid lubricants, ductile metals or their alloys and/or molten polymers are embedded in a network of cracks of hard chromium coatings to attain improved physical characteristics, primarily to increase wear resistance, sliding behavior, ductility and corrosion resistance.

The chrome plating process takes place in a microcrack-forming chrome-plating electrolyte with solid particles dispersed therein and with one-time or repeated current reversal so that, if the workpiece is connected to the anode, the network of microcracks in the chromium coating is widened and solid particles are embedded within the cracks. Preferred uses are as coatings on the bearing surfaces of piston rings or cylinder bearing sleeves for internal-combustion engines.

25 Claims, 1 Drawing Sheet

ELECTROLYTICALLY DEPOSITED HARD CHRONIUM COATINGS

This application is a continuation of application Ser. No. 06/904,022, filed Sept. 2, 1986.

BACKGROUND OF THE INVENTION

1. Field of the Invention

The present invention relates to an electrolytically deposited hard chromium coating having a network of cracks extending through the entire thickness of the coating and to a method for manufacturing it. More particularly, the invention relates to a coating having solid particles deposited within the cracks and a method of manufacturing thereof.

2. Description of the Background

Electrolytically deposited hard chromium coatings evidence substantial hardness which results in high wear resistance, very smooth surfaces which result in a low coefficient of friction, and low adherence as well as good resistance to chemically aggressive, corrosive, erosive and oxidative stresses, even at higher temperatures.

Thus, objects like the bearing faces of machine parts from, e.g., piston rings or cylinders in internal-combustion engines, are coated with hard chromium layers in order to attain special wear resistance. Pressing tools and pressing molds for the manufacture of molded plastic articles are also routinely coated with chromium layers to attain special smoothness and wear resistance. Further, fittings primarily in chemical plants are also especially protected by chromium coatings to attain a longer service life.

During the electrolytic deposition of chromium, relatively high tensile stresses develop in the chromium coatings. Once a certain thickness of the layer is reached, the expansion capability of the weakly elastic chromium results in the formation of microcracks which, when observed in an etched surface micrograph, appear in the form of a spider web-like network of fine lines and cracks. Such microcrack networks serve as oil grooves or oil cups, and facilitate, in oil lubricated wear protection coatings, the wetting of the chromium coatings with oil and thus the formation of an oil film required for lubrication. For this purpose, and in order to enlarge the network of cracks in the chromium, a porous chromium coating is formed by selecting suitable chrome plating parameters during or after the chrome-plating process, periodic current reversals, thermal post-treatments or etching processes. On the other hand, in order to attain good corrosion protection chromium coatings should be as free of cracks as possible. For this purpose, a chrome plating process is usually selected in which the chromium coatings have at most a network of microcracks.

Moreover, it is known that hard chromium coatings have little elasticity and are brittle. As a consequence of this, and primarily under intermittent stresses and greater shocks, breaks may occur in the coatings which may cause chipping.

It is known to embed finely dispersed solids particles in a matrix metal wherein the metal deposition is effected from an electrolytic bath which has solids particles finely dispersed therein. This improves the physical characteristics of electrolytically deposited metal coatings. For example, nickel dispersion coatings with embedded hard substance particles, primarily of silicon carbide, exhibit improved wear resistance. These nickel dispersion layers with embedded solid lubricant particles evidence a lower coefficient of friction. While the production of electrolytically deposited nickel dispersion layers is relatively problem free, chromium dispersion layers cannot easily be produced. Consequently, electrolytically deposited chromium dispersion layers having improved characteristics are not being used in practice. In this case, dispersed solid particles are prevented from being deposited in the chromium coating by a more extensive development of hydrogen around the chromium atoms during the electroplating process. Therefore, hard chromium coatings containing finely dispersed solid particles must be manufactured by relatively complicated processes, such as plasma spraying.

Thus, there still a need for a hard chromium coating which has improved physical and technological characteristics while lacking the above-listed drawbacks. At the same time, there also still is a need for an electroplating process of broad application with which such coatings can be produced in a simple and economical manner.

SUMMARY OF THE INVENTION

This invention provides an electrolytically-deposited hard chromium coating comprising a network of cracks which extends throughout the entire thickness of the coating, wherein solid particles are embedded within the cracks.

This invention also provides a method for producing a hard chromium coating on a substrate comprising chrome-plating the substrate connected to an anode in the presence of a microcrack-forming chrome-plating electrolyte comprising suspended solid particles, said plating being conducted at least once with the aid of stiring and/or blowing in an air for a time effective to deposit a hard chromium coating comprising a network of cracks which extends throughout the entire thickness of the coating, wherein solid particles are embedded within the cracks.

A more complete appreciation of the invention and many of the attendant advantages thereof will be readily perceived as the same becomes better understood by reference to the following description of the accompanying drawings.

BRIEF DESCRIPTION OF THE DRAWINGS

The three micrographs depict electron microscopic photographs of the hard chromium coatings according to the invention and produced as described in the Example included hereinbelow.

DESCRIPTION OF THE PREFERRED EMBODIMENTS

Figure 1:
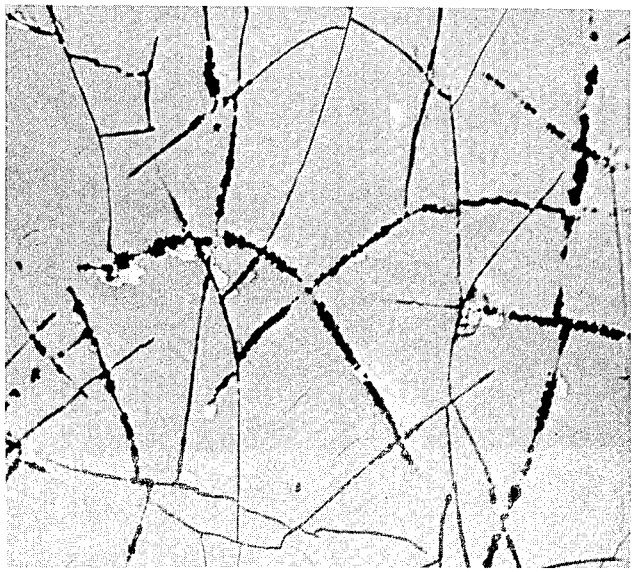
FIG. 1 is a surface micrograph enlarged one thousand times.

In FIG. 1, cracks can be seen extending through the chromium coating in the manner of a spider web. Silicon carbide particles can also be seen as light particles embedded in the cracks.

Figure 2:
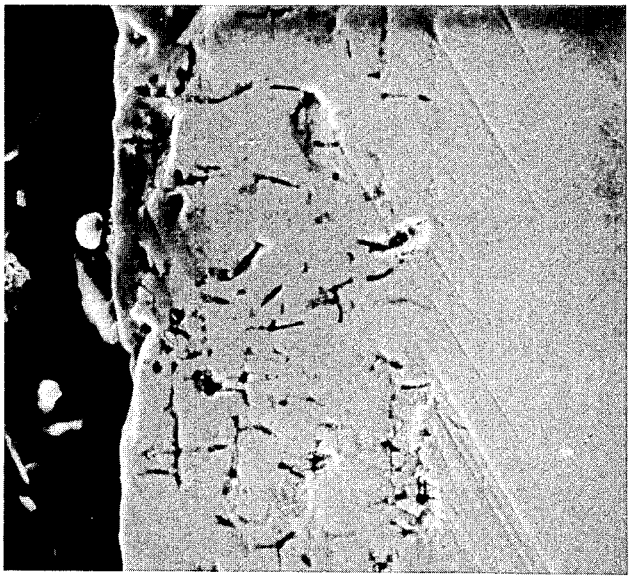
FIG. 2 is a transverse cut micrograph enlarged one thousand times.

The transverse cut micrograph of FIG. 2 shows the cross sections of cracks extending at approximately right angles to the surface. The cracks were sealed by the periodic current reversal during the chrome plating process by the formation of subsequent chromium layers, thereby encapsulating within the cracks embedded light-colored silicon dioxide particles.

Figure 3:
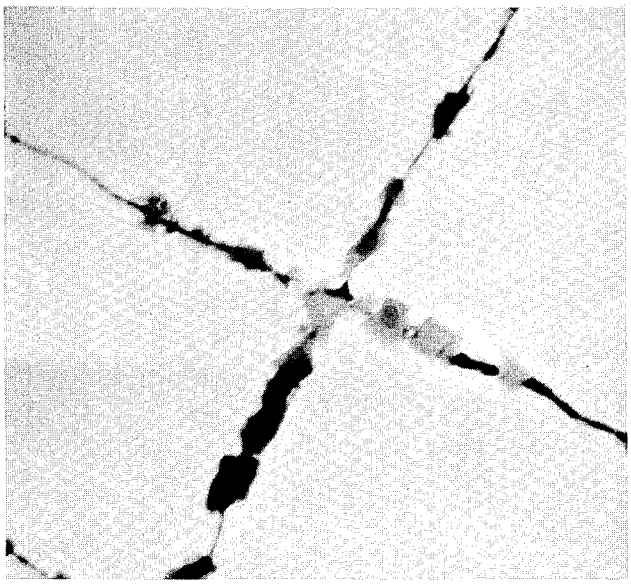
FIG. 3 is an oblique cut micrograph enlarged four thousand times.

The oblique cut micrograph of FIG. 3 in a four thousand fold enlargement, depicts the partial encasement of silicon carbide particles which are anchored in the cracks by subsequently deposited chromium layers.

The present invention provides a hard chromium coating which has solid particles embedded within its cracks. Preferably, the width of the cracks is greater than about 0.5 μm, more preferable greater than about 1 μm, in order that the solid particles may be embedded therein. The width of the cracks may be about 15 μm or even larger. A preferred thickness of the hard chromium coating is between about 10 μm and 1000 μm. It is provided herein an improved hard chromium coating which has solid particles embedded within its network of cracks. This novel coating has excellent application in, e.g., coatings having a high crack density, such as electrolytically-deposited dispersion layers, the characteristics of the hard chromium coating being determined to a great extent by the characteristics of the particles.

Accordingly, any materials known or employed for the production of electrolytically-deposited dispersion-coatings, employed individually or in combination, are suitable for use as solid particles. These materials should not dissolve in chromic acid baths used to form the microcracks, and their grain size be smaller than the width of the chromium cracks, i.e., preferably between about 0.5 μm and 15 μm. The thickness of the chromium coating should be greater, by a multiple, than the grain size of the particles.

Solid particles which may be employed to improve the wear resistance of the present coatings are preferably hard substance particles of materials such as, aluminum oxide, boron carbine, boronitride, chromium carbide, silicon dioxide, titanium carbide, diamond and/or tungsten carbide. Chromium layers containing such solids are then particularly suitable for the coating of bearing surfaces of piston rings or cylinder bearing sleeves in internal-combustion engines.

The solid lubricant particles employed are composed of hexagonal boronitride, graphite and/or polymer particles of primarily polyvinyl chloride and/or polytetrafluoroethylene.

To improve ductility or reduce brittleness, respectively, ductile metals or metal alloys of tin, titanium or bronze may be embedded in the cracks. The tendency that chromium displays toward adhesive wear can be reduced by embedding molybdenum particles in the chromium layer(s).

The color of the chromium coatings according to the invention can be varied by adding organic dyestuffs or colored metal salts to the chrome-plating electrolyte. The dyes are ultimately also embedded within the cracks. Filling the cracks with solid particles according to this invention increases the corrosion resistance of the novel chromium coatings. For this purpose, the cracks are preferably filled with polyvinyl chloride particles and the polyvinyl chloride is then melted within the cracks to seal the cracks and protect them against corrosive attack.

Solid particles of one substance or of a plurality of substances in a mixture may be used within the scope of the invention to fill the cracks to simultaneously improve several physical characteristics of the coatings. The cracks need not be filled completely with the solid particles, although they may be. It is also within the scope of the invention when depositing multiple chromium layers to fill the cracks of individual layers of the coatings with different types of solid lubricants. For example, cracks in the chromium coating zones immediately near the substrate may be filled with a corrosion preventing substance while the cracks in the outer zones of the chromium coating may be filled with wear particles or sliding substances or may even be free of particles which result in coatings which are protected against corrosion and simultaneously have good wear and slide characteristics. The outermost zones may additionally be filled with a substance enhancing break-in, such as elemental tin or iron oxide.

The chromium coatings according to the invention are produced in known microcrack forming chrome-plating baths. These are preferably chromic acid baths with solid particles dispersed therein. During the chrome-plating process, the substrate to be chrome-plated is initially connected to the cathode to form a chromium coating full of microcracks. Then, the substrate may be connected to the anode to broaden the microcracks to a desired width and may fill them with solid particles. Then, the workpiece may again be connected to the cathode to encapsulate the solid particles when the cracks close. This periodic reversal of current may be repeated several times, if necessary, with a person skilled in the art being able to vary the chrome-plating parameters to fit the needs of the case at hand, to attain a ratio desired crack width, crack density and crack fill, possibly with various solids particles.

Thus, the present invention provides hard chromium coatings whose physical and technological characteristics are significantly improved by the solid particles embedded in the cracks. As shown, the chromium coatings primarily exhibit improved wear resistance, sliding characteristics, break-in behavior, burn trace resistance, resistance to breaks and chipping off and a anti-corrosion behavior, all of these characteristics evidenced individually or in combination.

Any known solid particles which do not dissolve in chromic acid can be used to fill the cracks within the scope of the invention.

The novel method according to the invention enables a person skilled in the art to deposit the novel chrome coatings in a relatively simple manner to attain any desired characteristics for a specific case at hand, by means of a general process. This is accomplished by simply varying the chrome-plating parameters.

Having now generally described this invention, the same will be better understood by reference to certain specific example which is included herein for purposes of illustration only and is not intended to be limiting of the invention or any embodiment thereof, unless so specified.

EXAMPLE

The microcrack-forming chrome-plating electrolyte utilized contains 250 g/l chromic acid, and 2.5 g/l sulfuric acid, to which 50 g/l solid particles are added having grain sizes between about 0.5 μm and 5 μm. The particles are dispersed by stirring and kept suspended during the chrome plating process.

The chrome-plating process is conducted for about 5 hours at 55° C., and a chromium coating is formed having a final thickness of 0.2 mm.

A 5 cm long, 5 cm wide test rod having a 12 mm diameter is initially cathode chrome-plated for 30 minutes at 65 A/dm$^2$. Then, the coating is anodically etched by connecting the test rod to the anode for 30 seconds employing a current density of 150 A/dm$^2$. This is repeated, with the periodic chrome-plating switching taking place in a total of ten stages. Chrome plating and etching take place under the same process conditions.

The following solid materials were utilized in separate samples:

(a) silicon carbide particles were employed to produce wear coatings;

(b) hexagonal boronitride particles were employed to produce slide coatings with improved break-in behavior;

(c) polyvinyl chloride particles were used to produce coatings having improved corrosion behavior, the polymer in the finished coating being melted by heating for 10 minutes at 80° C.; and (d) lead chromate particles were employed to produce yellow coatings.

The manufactured test rods were found to have correspondingly improved technological and physical characteristics.

The present disclosure relates to the subject matter disclosed in German Patent application P 35 31 410.9 - 45 filed Sept. 3, 1985, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. An electrolytically-deposited hard chromium coating comprising multiple chromium layers, each layer having a network of cracks within at least one of which solid particles are embedded.

2. The hard chromium coating of claim 1, wherein the thickness of the hard chromium coating is between about 0.01 μm and 1.0 mm.

3. The hard chromium coating of claim 1, wherein the width of the cracks is greater than about 0.001 mm.

4. The hard chromium coating of claim 1, wherein the grain size of the embedded solid particles is about 0.0005 mm and 0.015 mm.

5. The hard chromium coating of claim 1, wherein the solid particles embedded in the cracks comprise a hard material.

6. The hard chromium coating of claim 5, wherein the hard material is selected from the group consisting of tungsten carbide, chromium carbide, aluminum oxide, silicon carbide, silicon nitride, boron carbide and diamond.

7. The hard chromium coating of claim 1, wherein the solid particles comprise a solid lubricant.

8. The hard chromium coating of claim 7, wherein the solid lubricant is selected from the group consisting of graphite, hexagonal boronitride and polytetrafluoroethylene.

9. The hard chromium coating of claim 1, wherein the solid particles embedded in the cracks are selected from the group consisting of ductile metals and metal alloys.

10. The hard chromium coating of claim 9, wherein the ductile metals and/or the metal alloys are selected from the group consisting of titanium, tin, iron oxide and bronze.

11. The hard chromium coating of claim 1, wherein the solid particles embedded in the cracks comprise melted thermoplastic polymers.

12. The hard chromium coating of claim 1, wherein the solid particles embedded in the cracks are selected from the group consisting of organic and inorganic dyestuffs.

13. The hard chromium coating of claim 1, wherein the said particles embedded in the cracks are mixtures of at least two components of the group consisting of hard substance particles, solids particles, metals, metal alloys, organic thermoplastics and organic and inorganic dyestuffs.

14. The hard chromium coating of claim 1, wherein the chromium coating comprises a plurality of chromium layers comprising different solid particles or solid particle mixtures enbedded within in the cracks of said layers.

15. The hard chromium coating of claim 14, wherein the cracks of each individual chromium layer are filled to a different degree with solids particles.

16. The hard chromium coating of claim 1, wherein at least one layer of said multiple chromium layers contains a hard material.

17. The hard chromium coating of claim 16, wherein at least one other layer of said multiple chromium layers contains a solid lubricant.

18. The hard chromium coating of claim 16, wherein at least one other layer of said multiple chromium layers is free of solid particles.

19. A method for electrolytically depositing a hard chromium coating on a substrate comprising chrome-plating the substrate connected as a first electrode in the presence of a microcrack-forming chrome-plating electrolyte contacting a second electrode and containing suspended solid particles, said plating being conducted at least once with the aid of stirring and/or blowing in air for a time effective to deposit a hard chromium coating having a network of cracks which extends throughout the entire thickness of the coating, and having solid particles embedded within the cracks; and said plating being carried out during a plurality of plating periods including at least one period during which the substrate is connected as a cathode and the electrolyte contacts an anode and at least one plating period during which the substrate is connected as an anode and the electrolyte contacts a cathode.

20. The method of claim 19, wherein the time during which the workpiece is connected as a cathode is longer by a multiple than the time during which the workpiece is connected as an anode.

21. The process of claim 19, wherein the thickness of the hard chromium coating is between about 0.01 μm and 1.0 mm.

22. The process of claim 19, wherein the width of the cracks is greater than about 0.001 mm.

23. The process of claim 19, wherein the grain size of the embedded solid particles is about 0.0005 mm and 0.015 mm.

24. The process of claim 19, wherein the solid particles are selected from the group consisting of tungsten carbide, chromium carbide, aluminum oxide, silicon carbide, silicon nitride, boron carbide, diamond, graphite, hexagonal boronitride, polytetrafluoroethylene, titanium, tin, iron oxide, bronze, thermoplastic polymers, and organic and inorganic dyestuffs.

25. A method for electrolytically depositing a hard chromium coating on a substrate, comprising:

chrome-plating the substrate connected as a first electrode in the presence of a microcrack-forming chrome-plating electrolyte contacting a second electrode and containing suspended solid particles, said plating being conducted at least once with the aid of stirring and/or blowing in air for a time effective to deposit a hard chromium coating having a network of cracks which extends throughout the entire thickness of the coating, and having solid particles embedded within the cracks; and further chrome-plating the substrate in the presence of a microcrackforming chrome-plating electrolyte in the substantial absence of solid particles.

* * * * *

UNITED STATES PATENT AND TRADEMARK OFFICE

CERTIFICATE OF CORRECTION

PATENT NO. : 4,846,940

DATED : July 11th, 1989

INVENTOR(S) : Hans-Jochem Neuhäuser et al.

It is certified that error appears in the above-identified patent and that said Letters Patent is hereby corrected as shown below:

IN THE TITLE:

Please correct the title of the invention to read --

ELECTROLYTICALLY DEPOSITED HARD CHROMIUM COATINGS -- .

Signed and Sealed this

Sixteenth Day of October, 1990

*Attest:*

HARRY F. MANBECK, JR.

*Attesting Officer*

*Commissioner of Patents and Trademarks*